US007059759B2

(12) United States Patent
Hummer

(10) Patent No.: US 7,059,759 B2
(45) Date of Patent: Jun. 13, 2006

(54) METHOD AND A PROCESS PLANT FOR TREATING A BATCH OF LIQUIDS

(75) Inventor: Jan Stumpe Hummer, Charlottenlund (DK)

(73) Assignee: ISO-Mix A/S, Ishoj (DK)

( * ) Notice: Subject to any disclaimer, the term of this patent is extended or adjusted under 35 U.S.C. 154(b) by 57 days.

(21) Appl. No.: 10/378,105

(22) Filed: Feb. 25, 2003

(65) Prior Publication Data

US 2003/0137895 A1 Jul. 24, 2003

Related U.S. Application Data

(63) Continuation of application No. PCT/DK01/00602, filed on Sep. 19, 2001.

(30) Foreign Application Priority Data

Sep. 22, 2000 (WO) ..... PCT/DK00/00525

(51) Int. Cl.
*B01F 5/02* (2006.01)

(52) U.S. Cl. ..... 366/137; 366/168.2; 366/169.1

(58) Field of Classification Search ..... 366/136, 366/137, 159.1, 167.2, 168.2, 169.1, 169.2, 366/170.4; 239/227
See application file for complete search history.

(56) References Cited

U.S. PATENT DOCUMENTS

| | | | | | |
|---|---|---|---|---|---|
| 144,696 | A | * | 11/1873 | Orr | 239/227 |
| 1,806,740 | A | * | 5/1931 | Butterworth | 134/24 |
| 2,661,241 | A | * | 12/1953 | Veneziano | 239/227 |
| 3,001,534 | A | * | 9/1961 | Grant | 134/167 R |
| 3,052,574 | A | * | 9/1962 | Kennedy | 134/24 |
| 3,255,969 | A | * | 6/1966 | Saad | 239/227 |
| 3,544,012 | A | * | 12/1970 | McNally | 239/227 |
| 3,814,003 | A | | 6/1974 | Vacano | 99/276 |
| 3,902,670 | A | * | 9/1975 | Koller et al. | 239/227 |
| 4,166,704 | A | * | 9/1979 | Albert | 366/168.2 |
| 4,244,524 | A | * | 1/1981 | Wellings | 239/227 |
| 5,333,630 | A | | 8/1994 | Jepsen et al. | 134/104.1 |
| 5,591,272 | A | * | 1/1997 | Hummer | 134/10 |
| 5,715,852 | A | * | 2/1998 | Jepsen | 134/167 R |
| 2003/0145880 | A1 | * | 8/2003 | Jepsen et al. | 134/167 R |

FOREIGN PATENT DOCUMENTS

| | | | |
|---|---|---|---|
| AU | B-20242/95 | | 4/1996 |
| WO | WO 01/76781 | A1 * | 10/2001 |
| WO | WO 02/024317 | A1 * | 3/2002 |
| WO | WO 03/022464 | A2 * | 3/2003 |

* cited by examiner

*Primary Examiner*—David Sorkin
(74) *Attorney, Agent, or Firm*—Thomas R. Vigil; Welsh & Katz, Ltd.

(57) ABSTRACT

A process plant comprises a tank (1), an outlet conduit (2), a reservoir of cleaning agent (12), or feedstock(s) of additive(s) (13), a loop conduit (3) for returning liquid into the tank, valve means (9) for controlling admission of liquid into the loop conduit and a pump (4) for driving liquid through the loop conduit. Returning of the liquid takes place through a jetting device (5) adapted for introducing jets of liquid into the body of liquid inside the tank in order to cause stirring to the body of liquid. The jet nozzle is adapted for powered rotation about a first axis and about a second axis perpendicular, or non-perpendicular, to the first axis. The jet nozzles may be embodied in a flat jet rotating around one axis only. Upon emptying the tank, the jetting device may serve for cleaning the tank by spraying liquid onto the tank walls. The invention provides a method for treating liquid as well as a process plant.

22 Claims, 10 Drawing Sheets

1st Cycle

2nd Cycle

Full Pattern

METHOD AND A PROCESS PLANT FOR TREATING A BATCH OF LIQUIDS

CROSS-REFERENCE TO RELATED APPLICATIONS

Figure 1A:
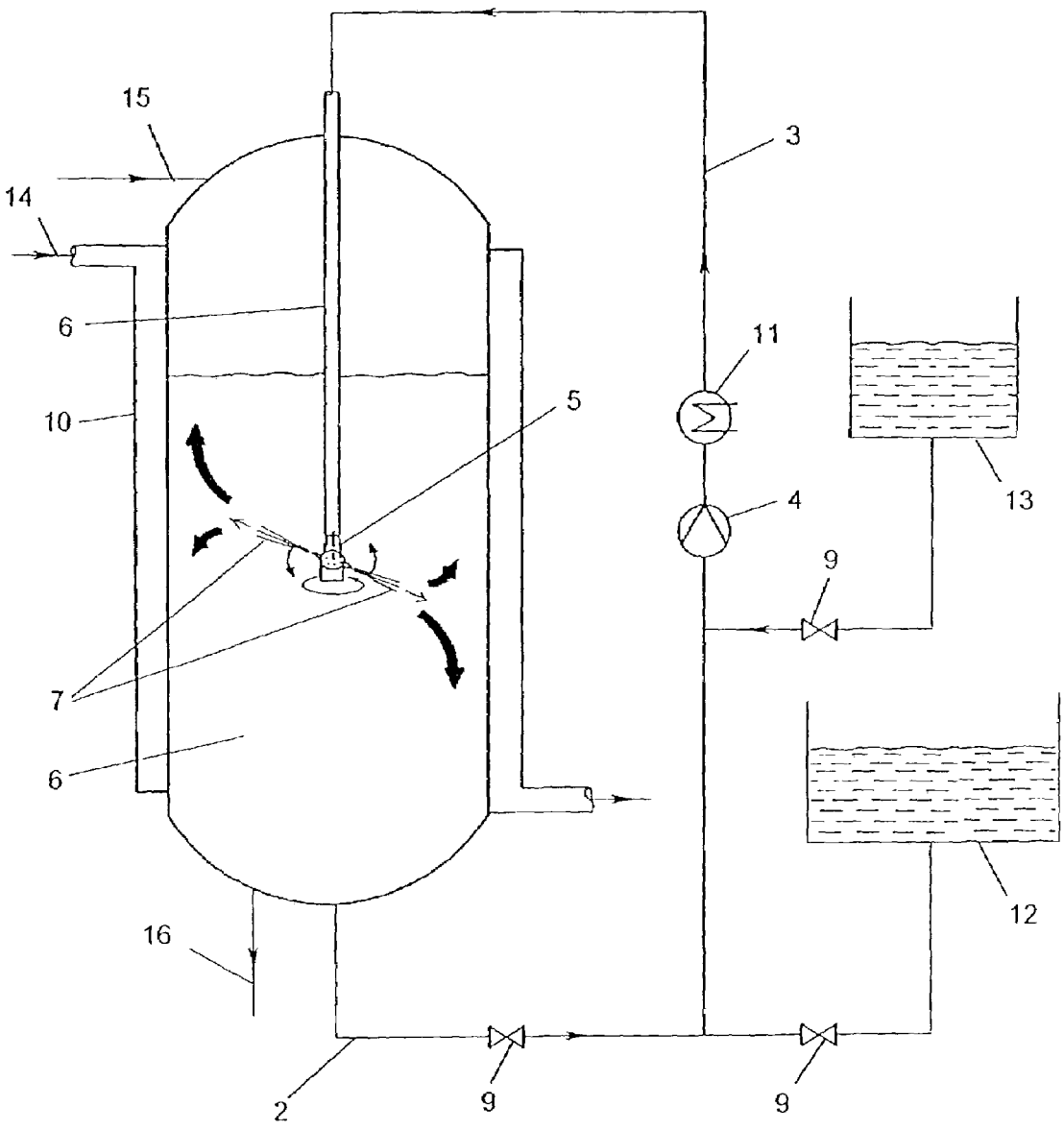

This application is a continuation of PCT/DK01/00602, filed Sep. 19, 2001.

BACKGROUND OF THE INVENTION

1. Field of the Invention

The present invention generally relates to the treatment of liquids stored in tanks and to methods of agitating and stirring liquids.

More specifically, the invention relates to a method of treating a body of liquid in a tank, to a method of operating a process plant, and to a process plant.

2. Description of the Related Art

In the art of treating liquids, measures for stirring or agitating the liquid frequently are of major importance, such stirring serving purposes such as homogenization, i.e. equalization of differences in concentration and temperature, intensification of heat transfer between the liquid and a heat exchange surface, suspension of dissolution of a solid in the liquid, dispersion of immiscible liquids or sparging of a gas in the liquid. Particular fields of application within biotechnology industries comprise beer fermenters or yeast tanks, wherein mixing is applied in order to obtain uniformity in concentration of ingredients and temperature. Other fields of application are the processing of foods or cosmetics wherein there is a need for mixing minute quantities of ingredients into large volumes of matter. Other fields of application are found in the pulp and paper industry and within general chemical industries related to processes for the preparation of paints, of polymers, of drilling muds and others.

Mixing operations are often performed in vessels provided with various agitation means such as rotary impellers or jets. Baffles are typically provided for serving the purpose of preventing bulk rotation or swirling of the contents in the tank due to the effect of a rotating impeller or similar. The baffles sometimes used to prevent swirl or vortex formation represent a structural complication and also an operational complication due to the creation of dead volumes and due to the shadowing of surfaces that complicates cleaning.

Rotary impellers require drive motors and structural support for bearings as well as for the motors. A rotary impeller for a large tank typically comprises a rotary shaft with several stages of impellers. The rotary shaft is typically supported by bearings in both ends as well as by bearings intermediate the ends. Rotary impellers are often incorporated in closed vessels wherein the shaft penetrates the wall of the vessel. The impeller blades, the bearings and the supporting structure all adds to the complications in cleaning due to the extra surfaces and due to shading effects.

Cleaning is another basic process in process plants, which in general terms fulfils the purpose of removing residues for a variety of purposes such as for avoiding cross contamination, avoiding build up of barrier layers, and preparing the respective part of the plant for another batch of product, whether of a similar type or of a different type.

U.S. Pat. No. 5,620,250 teaches a jet mixer comprising a rotary impeller driven in rotation by the thrust from jets arranged at the tips of the impeller blades. Rotation is driven by the introduction of fluid, which fluid also provides a bearing between a body portion and the impeller. The stated object of this device is to provide mixing without a requirement for a motor and a gearbox with seals.

A mixer of this kind suffers certain restrictions in fields of application. Driving the rotary impeller by the reaction force created by the jets makes the speed of revolution highly variable depending on the fluid pressure applied and the viscosity of the body of liquid in the tank. Further, an impeller rotating about a fixed axis is bound to create a steady pattern of circulation in the tank that may leave dead volumes or volumes with low rates of agitation, in particular in case the tank is provided with internal structural elements as may often be the case. Agitation by an impeller rotating about a fixed axis is likely to create a swirl or a vortex inside the tank that may have to be countered by additional measures. Further, the impeller gives rise to shading that complicates cleaning of the tank inside, and the impeller by itself introduces surfaces that may need special precautions in the cleaning.

U.S. Pat. No. 4,166,704 discloses a rotating fluid jet agitator for mixing, comprising primary jet mixing nozzles arranged to rotate about a vertical axis and adapted to project streams of liquid along the plane of rotation, and a drive nozzle arranged to deliver a thrust which causes the primary nozzles to rotate about the vertical axis. The drive nozzle may be adapted for rotation about a horizontal axis, in which case the drive nozzle is structurally connected to a drag plate which is rotated due to the force of gravity balanced by the drag created in rotation, thus controlling the angle of the drive nozzle and thereby the net torque applied by the drive nozzle to the rotation of the primary nozzles.

Thus the primary nozzles rotate about a fixed vertical axis, whereas the drive nozzle may oscillate about a horizontal axis in a way with no positive control.

Rotating the jets by the reaction force from one jet is likely to be variable with respect to speed depending on factors such as drive fluid pressure and viscosity of the bulk of liquid inside the tank. Agitation by the effect of the jets from nozzles rotating about a stationary vertical axis is likely to create a fairly steady pattern of agitation that may leave a dead volume, e.g. in parts of the tank volume far away from the plane of rotation of the primary nozzles.

U.S. Pat. No. 5,810,473 discloses a liquid jetting device having a nozzle, which device is provided with separate power sources for swinging the nozzle in the vertical and horizontal directions. The jetting device is adapted for installation at the sidewall or at the top of a large oil tank for serving the purpose of fluidizing petroleum sludge to prevent the precipitation of sludge or to remove deposits on the tank floor. The nozzle injects high-pressure fluid provided by withdrawing a flow of liquid from the contents of the tank. Swinging of the nozzle is confined to stay within sectors of angles only.

The drive mechanism for swinging the nozzle comprises a complicated set of gears and end-stop switches and a set of seals and packings for allowing the shafts to cross the barrier to the high-pressure liquid.

An apparatus of this kind is subject to certain constraints. Swinging of the nozzle about two perpendicular axes by respective power drives does not inherently guarantee evenly distributed coverage of the volume by the jets. Agitation of the liquid by a wall mounted nozzle device is likely to create a net reaction force onto the nozzle base that strains the structure. Inside the body of liquid, agitation by a wall mounted nozzle is quite likely to create a rather steady pattern of flow, e.g. a swirl or another pattern that may leave dead volumes.

U.S. Pat. No. 5,333,630 discloses an apparatus for the cleaning of a closed compartment, which apparatus comprises a hub with nozzles arranged for rotation in a lower housing portion about a horizontal axis, which lower housing portion is again arranged for rotation about a vertical axis. The nozzle head is provided with a turbine and with gears for effecting rotation about both of these axes in order that the nozzles during rotation can sweep the whole of the interior of the closed compartment. This apparatus is adapted for cleaning compartments by means of sprayed out liquids. The gears are rinsed through by the liquid and the apparatus comprises slots and openings for allowing liquid to flow out in order to sweep the outside of the housing so as to make the apparatus self-cleaning.

Within this context the tank may comprise any container or generally closed envelope or structure adapted for generally enclosing a volume of liquid. Examples of such envelopes comprise any kind of tanks, containers, conduits or pipes. The dwell time of the liquid may range from seconds, as in the case of a pipeline that serves primarily for transportation, to days, months or years, as in the case of a container that serves primarily for storage purposes.

BRIEF SUMMARY OF THE INVENTION

The method according to the invention provides for agitation and stirring to a body of liquid contained inside a tank in a very effective manner where the jets may swing in order to effectively cover all directions successively. As the nozzles have no steady directions, the flow pattern inside the tank will continually change through a great range of patterns, thus creating a maximum degree of turbulence that dissipates in all directions.

As any steady flow pattern may leave dead volumes, the continuous swinging of the nozzles enhances the stirring effect and provides a maximum probability that agitation will reach all parts of the volume. The method avoids the need for baffles to control the flow inside the tank. The method minimizes the need for bearings and structural support inside the tank. In case the tank comprises internal baffles or other structures anyhow, the method has superior capabilities for creating agitation of all parts of the volume inside the tank, including such volumes that may be shaded. The method can be implemented with a minimum of mechanical structure inside the tank, and such structure can be made effectively self-cleaning.

This method may be implemented by simple structural means as swinging of the jetting device about two mutually perpendicular, or non-perpendicular, axis is achieved by common, or separate, power means. The provision of the power means enables a positive control of the velocity of rotation. The power means may comprise any suitable power units, e.g. motors or turbines, arranged adjacent the jetting device or spaced from the jetting device. The power sources may be the flow of liquid for the jets or a separate power input, e.g. by fluid or by electric power supply.

According to a preferred embodiment, the jetting device is adapted for lubricating the bearings and the gear means by the flow of pressurized liquid. This provides effective means of lubrication and dispenses with the need for seals. Further, it avoids the risk of contaminating the tank contents with foreign matter.

According to a preferred embodiment, the power means comprises gear means adapted to effect rotation about the second axis at a speed of revolution that is different from the speed of revolution about the first axis. Thus, one full rotation about the second axis takes the nozzle back to a position that is offset from the starting position with an angle about the first axis. Hereby the nozzle for every new revolution about the second axis sweeps a different area inside the tank so as to index the generally circular trace swept by the nozzle.

According to a preferred embodiment, the power means comprises a turbine driven by the flow of pressurized liquid and gear means for deriving the rotation of the nozzle about the first axis and about the second axis from the rotation of the turbine. This provides a simple means for deriving the force for driving the rotation, avoiding all further complications. The speed of revolution may be controlled by controlling the pressure and the flow of the drive fluid, keeping in mind that the speed of the turbine is likely to vary with pressure although the speed is not as volatile as is the case with impellers driven by the reaction force from the jets.

According to a preferred embodiment, the jetting device is adapted for self-draining of all liquid. This facilitates the procedure of switching contents inside the tank, e.g. in order to remove the batch and to enter a new batch into the tank.

According to a preferred embodiment, the jetting device is adapted to scan the nozzle through a path generally covering a complete sphere. This achieves effective coverage of all volume within reach of the jets. Further, this ensures that any impact on the contents of the tank, e.g. an impact momentarily tending to create a bulk rotation or a swirl inside the tank, will generally by offset by a counter impact at some other instant.

According to a further preferred embodiment, the jetting device is adapted for providing jets that are generally balanced in order to create no net thrust to the jetting device. This relieves the jetting device of net reaction forces, thus easing structural requirements. This permits installation of the jetting device at the end of a lance as the lance will generally be subjected to only minor forces, e.g. to minor torque. This makes it possible for instance to suspend the jetting device in a pipe extending from the top of the tank, as generally preferred for ease of installation and ease of maintenance, also in cases where the jetting device is required to develop maximum effect close to the tank bottom in order to agitate the contents of the tank effectively at that position.

According to a preferred embodiment, ingredient is added to the liquid contained in the tank by way of adding the ingredient to the flow prior to being reintroduced into the tank through the jetting device. Ingredients can be either gasses, liquids, solids, or combinations thereof. This facilitates introducing an ingredient to the tank and provides effective and prompt mixing of the ingredient into the contents inside the tank.

In case the ingredient is a gas, the gas will be carried by the pressurized liquid and meets the contents of the tank at a lower pressure. This produces a spray of small gas bobbles which further improves an effective and prompt mixing and reaction with the contents of the tank.

A gas comprises one or more gasses of e.g. oxygen, carbon dioxide, methane, hydrogen, nitrogen, and combinations thereof.

A liquid comprises one or more liquids of e.g. pure liquids, solutions, gaseous dispersions, liquid dispersions, solid dispersions, emulsions, and combinations thereof.

The invention also relates to a method.

This provides a simple and effective method of agitating the batch of liquid, withdrawing the batch of liquid and subsequently cleaning the tank since the same jetting device may be used for the agitation and for the cleaning. Generally the jetting device is very effective for cleaning as the jetting device is capable of effectively sweeping the entire tank inside wall depending on proper conditions concerning tank size, pressure of cleaning agent etc.

The invention, further related to a process plant.

This process plant is effective for the treatment of batches of liquid and effective in cleaning the tank following removal of the batch as the same jetting device may selectively be deployed for agitation and for cleaning. The cleaning device serves a dual purpose and effectively dispenses with a need of respective dedicated means for agitation and for cleaning.

BRIEF DESCRIPTION OF THE SEVERAL VIEWS OF THE INVENTION

Figure 1B:
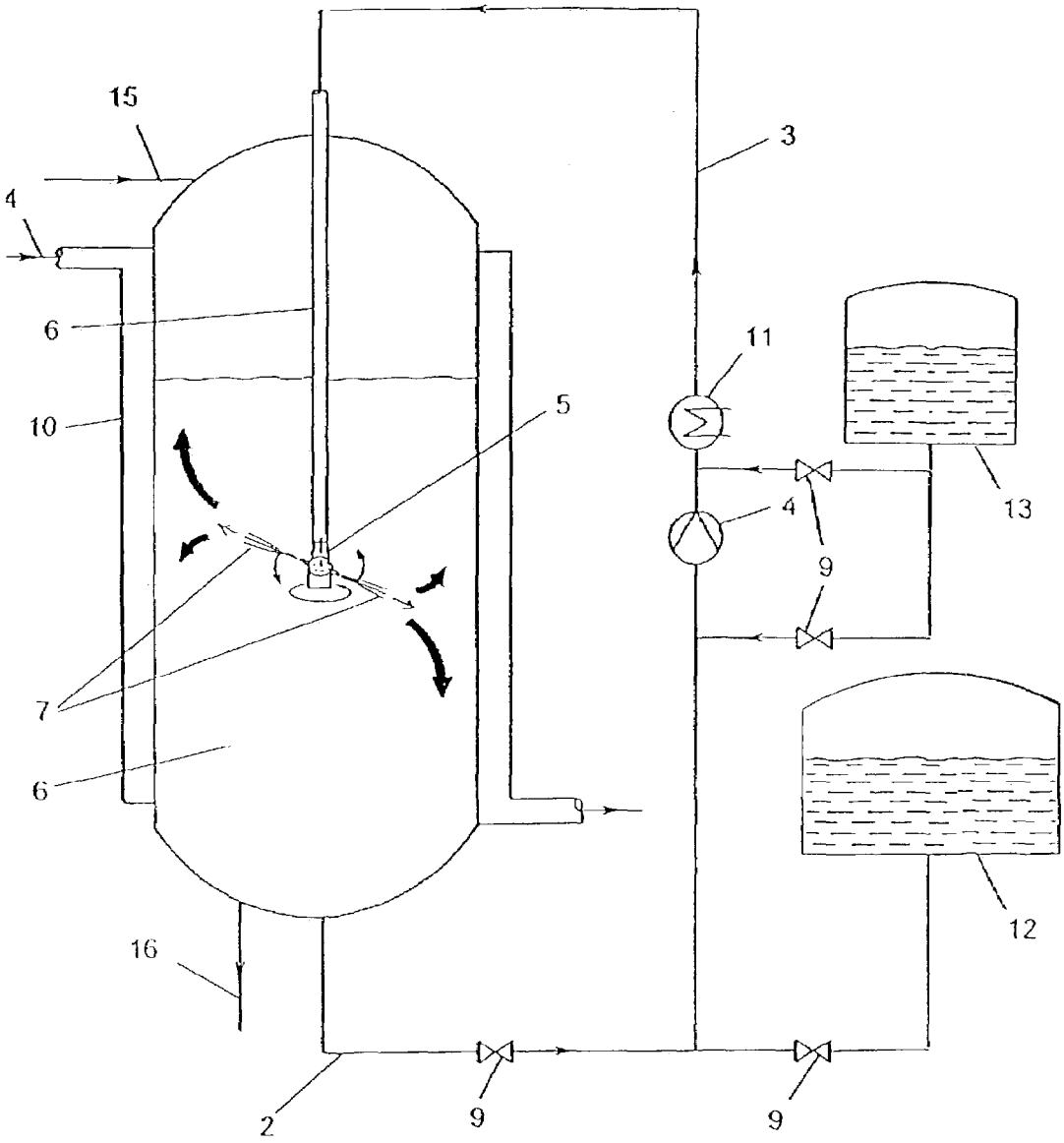
Figure 2:
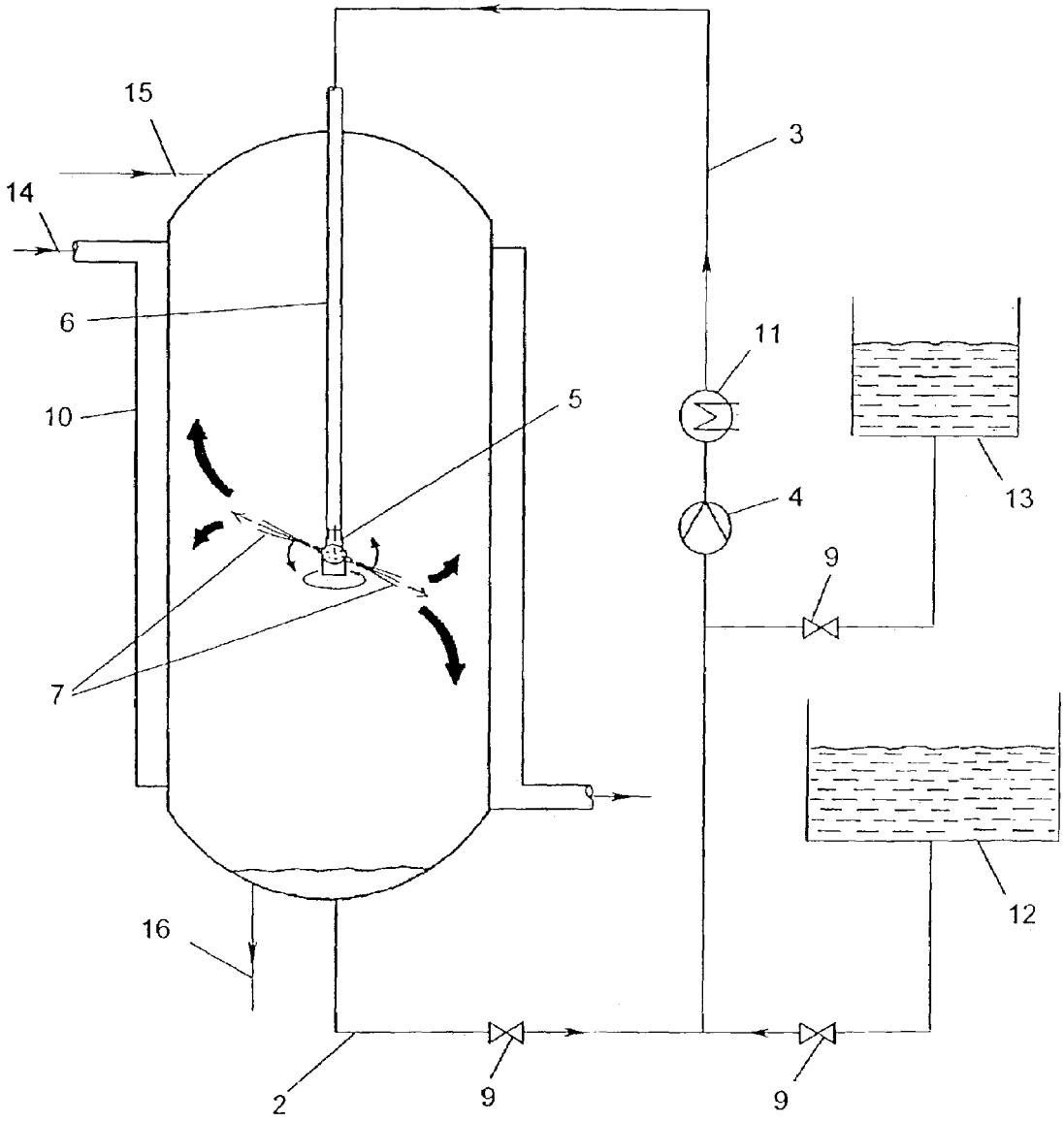
Figure 3:
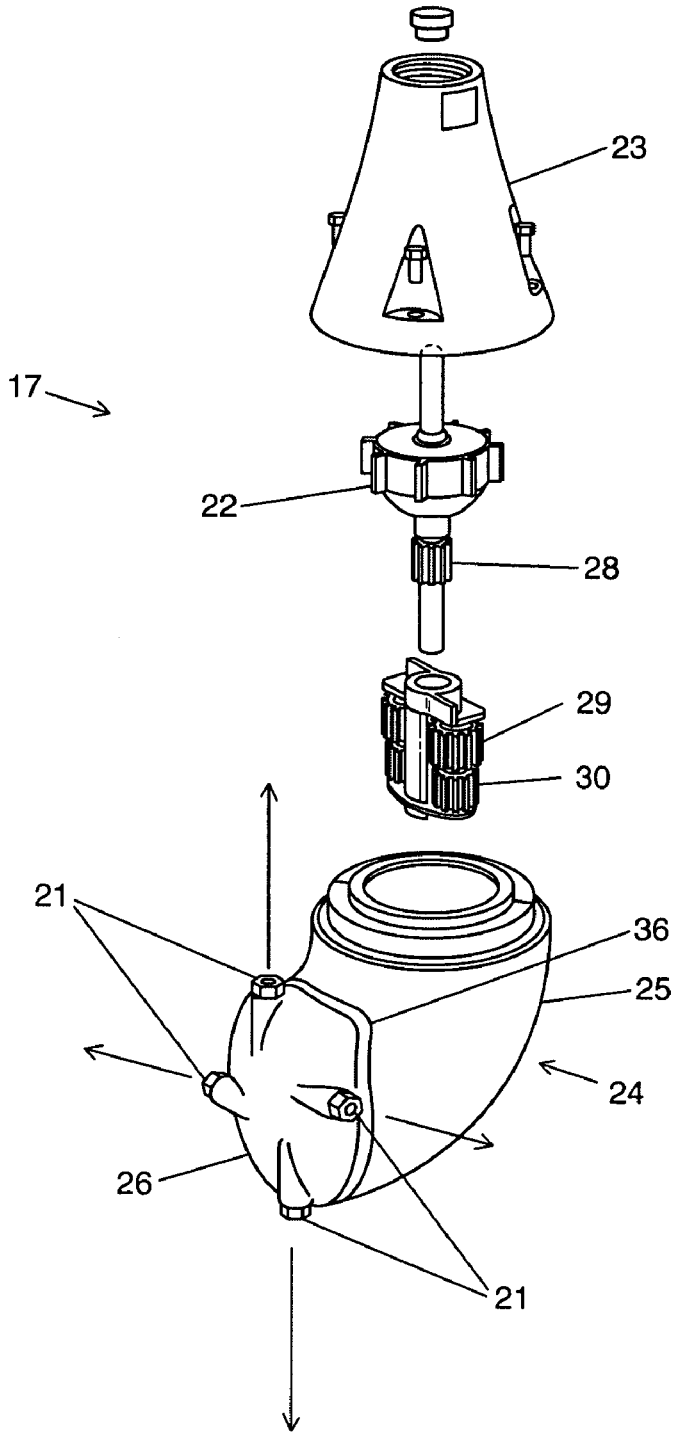
Fig. 3 PRIOR ART
Figure 4:
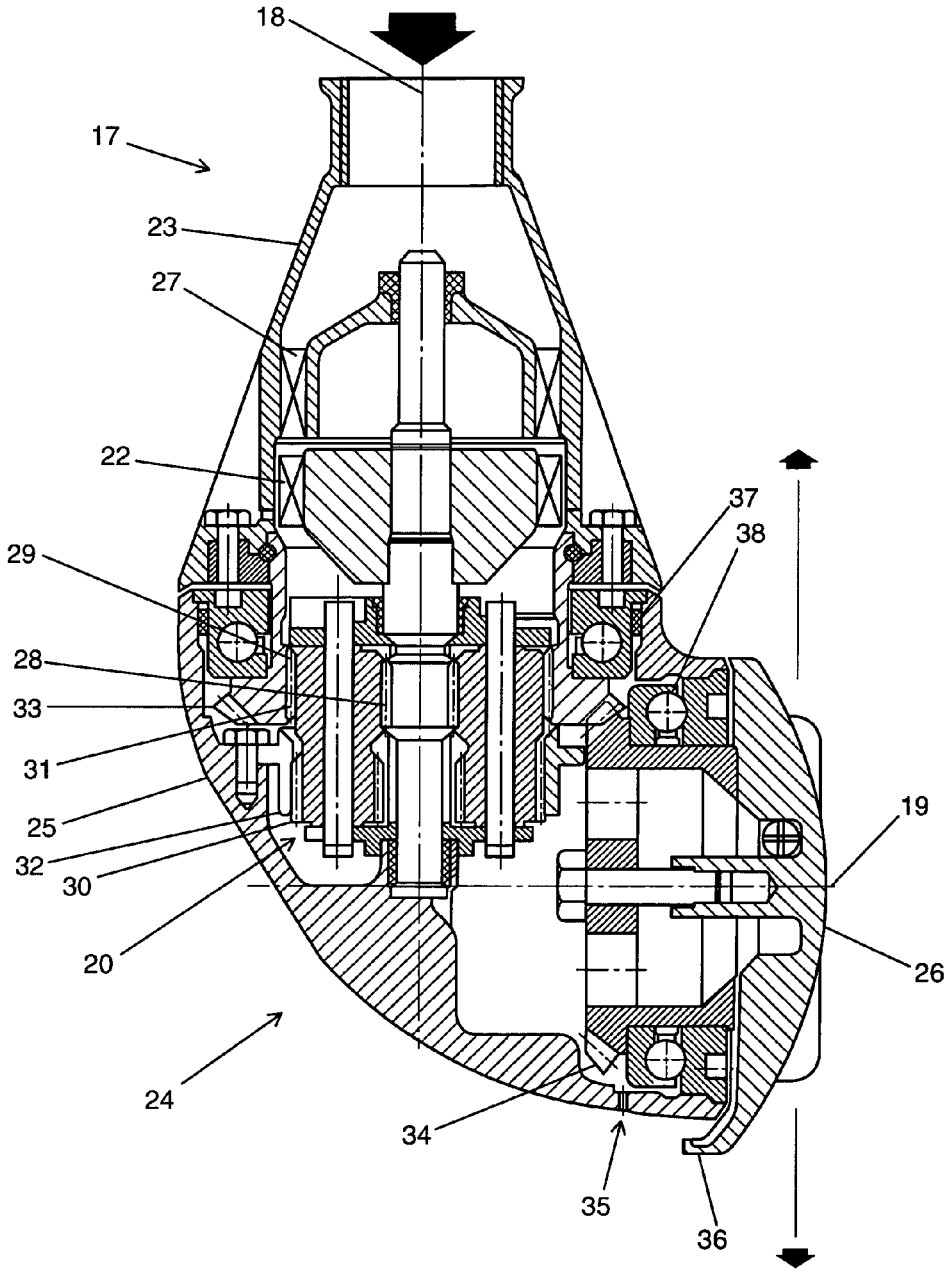
Fig. 4 PRIOR ART
Figure 5:
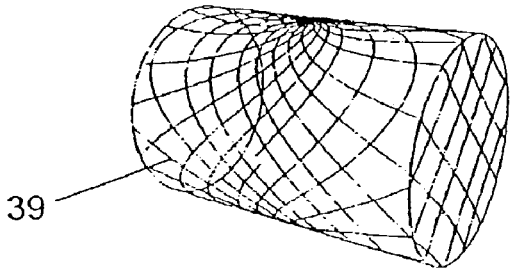
Figure 5:
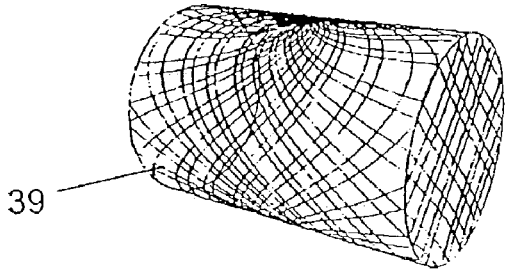
Figure 5:
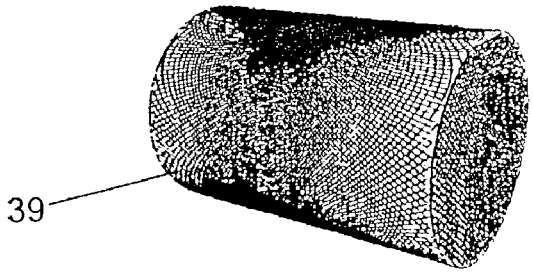
Figure 6:
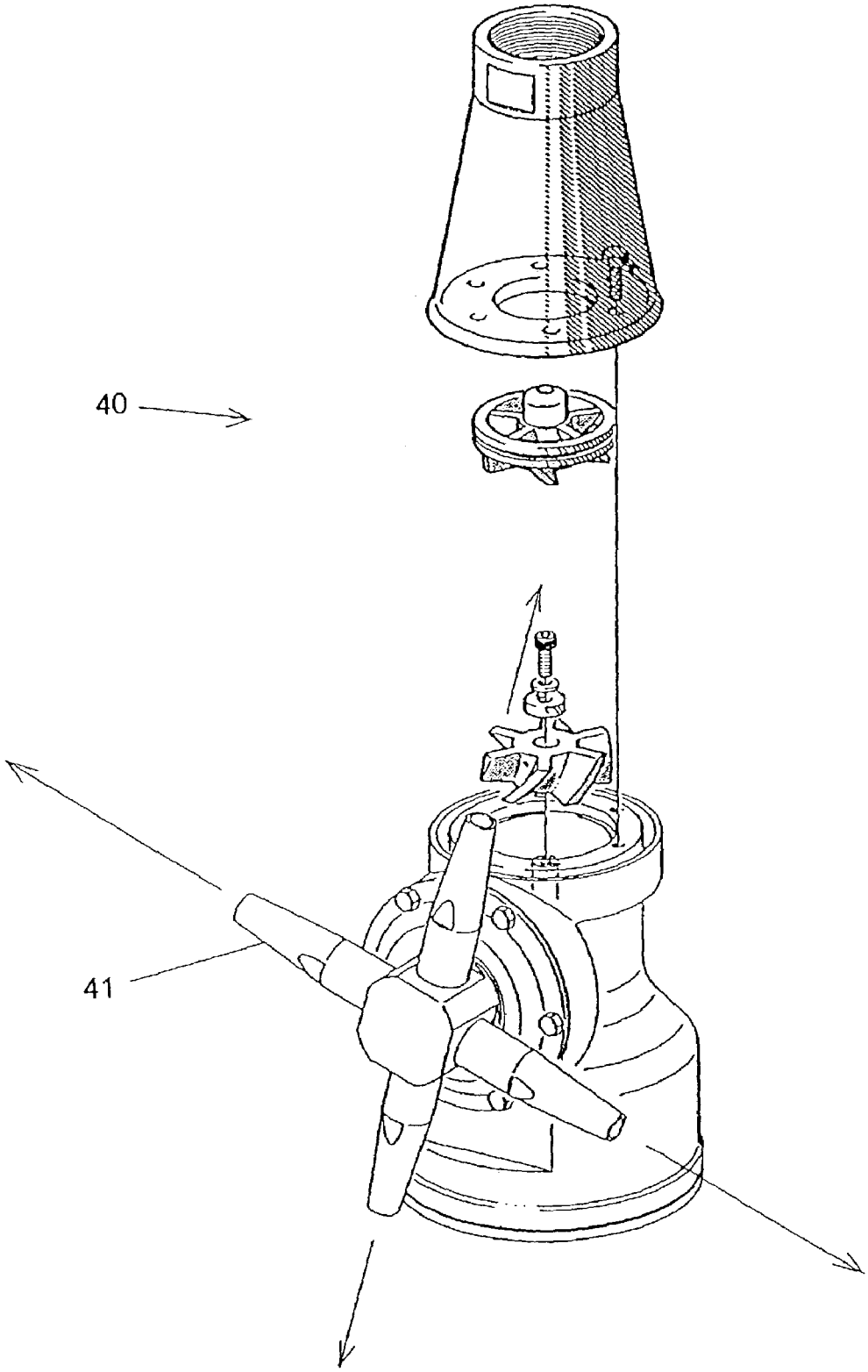
Figure 7:
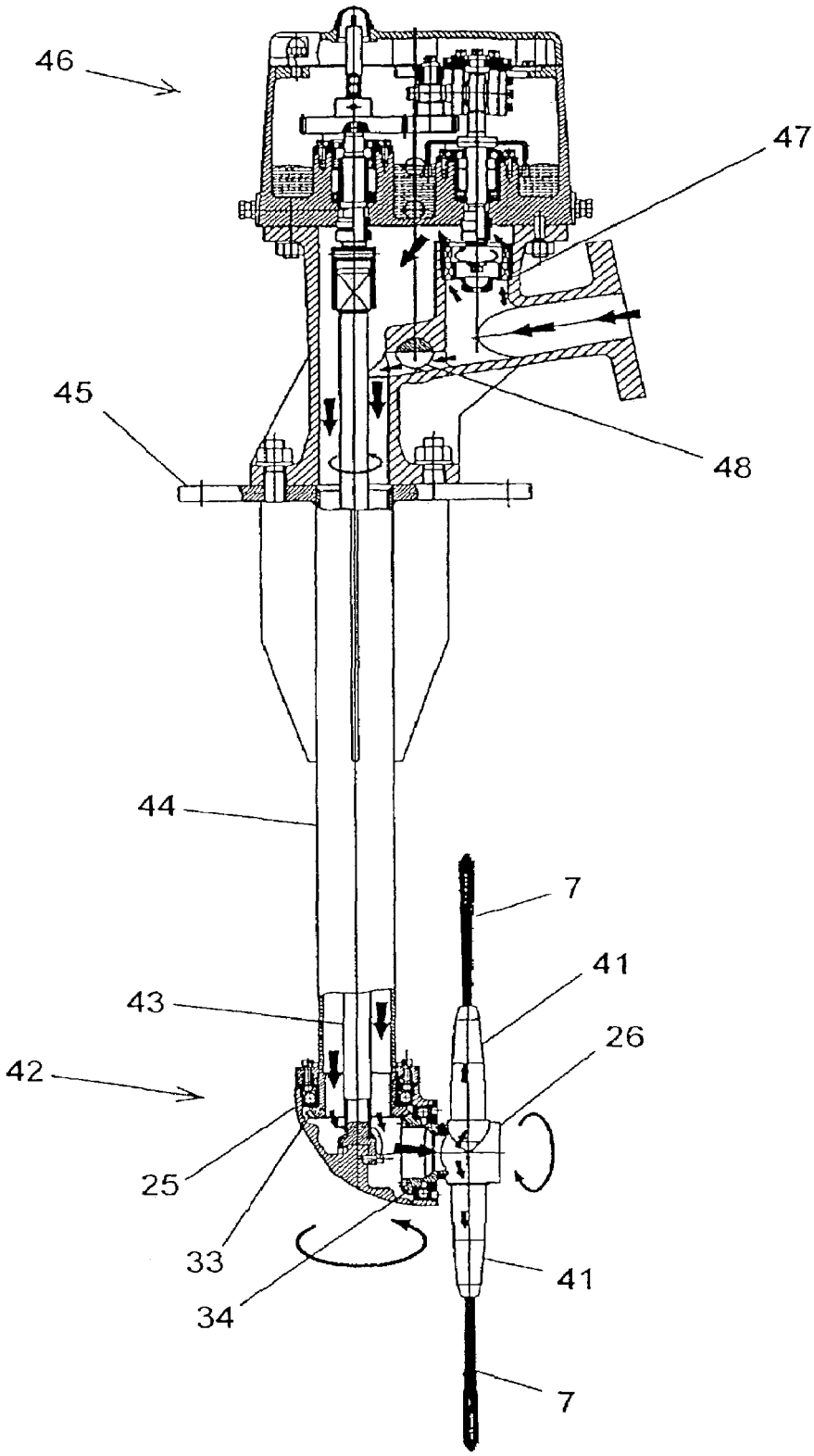
Figure 8:
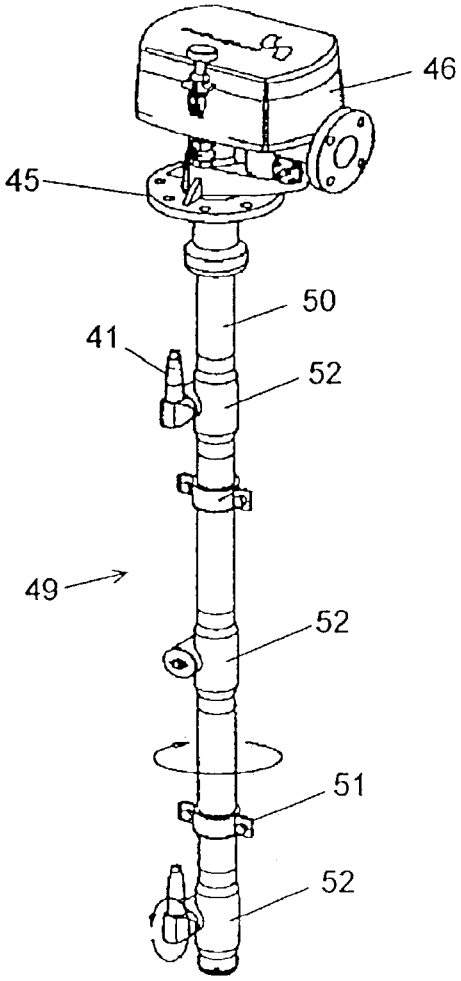
Figure 9:
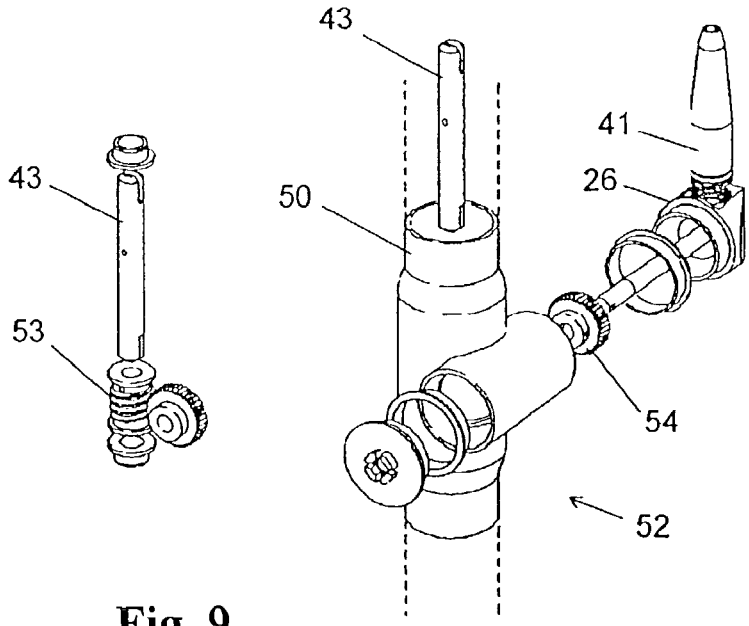
Figure 10:
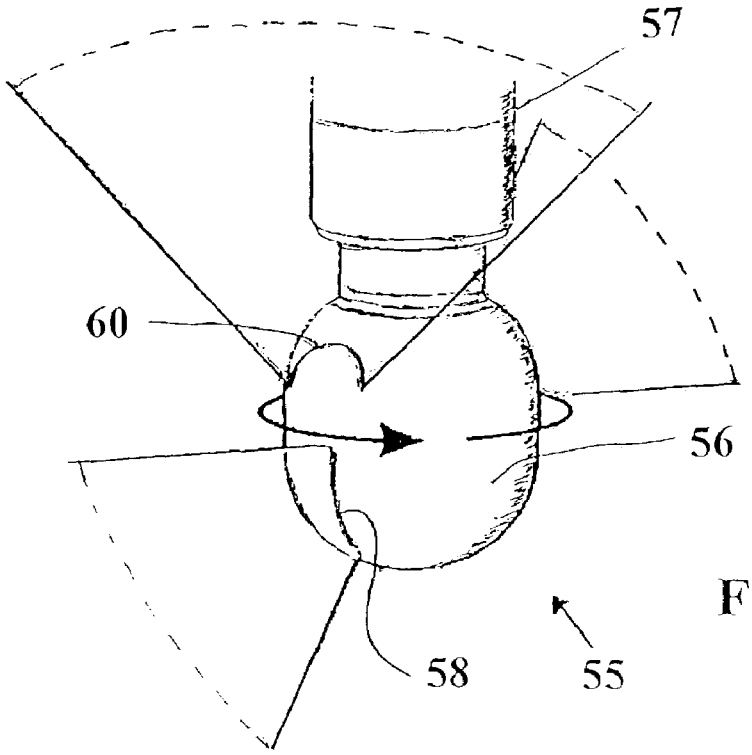
Figure 11:
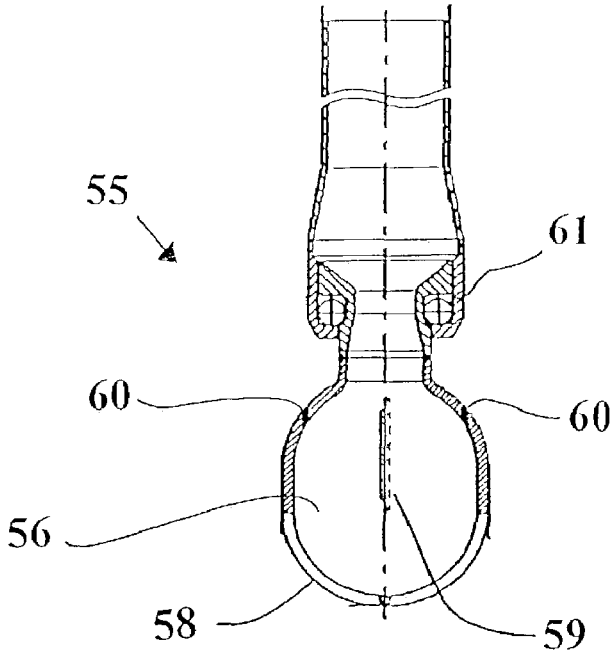

Further object, advantages, and features of the invention will appear from the appended description of preferred embodiments given with reference to the drawings wherein FIG. 1A shows a schematic outline of a process plant during a stage of stirring a batch of liquid, FIG. 1B shows a similar schematic outline as shown in FIG. 1A, wherein the feedstock container consists of a pressurized gas container, FIG. 2 shows a schematic outline of a process plant during a stage of cleaning a tank, FIG. 3 shows a slim-bodied jetting device in exploded view, FIG. 4 shows the slim-bodied jetting device in vertical section, FIG. 5 shows plots of the tracks by the jets impacting the inside of a horizontal cylindrical tank, FIG. 6 shows a wide-bodied jetting device in exploded view, FIG. 7 shows a shaft-drive jetting device in vertical side view, partially sectioned, FIG. 8 shows a multi-stage jetting device in perspective view, FIG. 9 shows part of a multi-stage jetting device in exploded view, FIG. 10 shows a rotary flat jet head device in side view, and FIG. 11 shows a rotary flat jet head device of FIG. 10 in vertical section.

All figures are schematic, not necessarily to scale, and show only items essential to the understanding of the invention, whereas other items have been deleted for the sake of clarity.

Throughout the figures the same references are used for identical or similar items.

DETAILED DESCRIPTION OF THE PREFERRED EMBODIMENTS

Reference is first made to FIG. 1A, which illustrates a schematic outline of a process plant according to an embodiment of the invention. This process plant comprises tank 1, outlet conduit 2, loop conduit 3, pump 4 and rotary jet head 5. The rotary jet head is suspended in a pipe 6 and adapted in way to be explained more in detail below to emit jets 7 or sprays of liquid for agitating the body of liquid 8 contained inside the tank 1.

The plant further comprises a container holding a feedstock of cleaning agent 12 and another container holding a feedstock of additive 13; said additive being e.g. ingredients in one or more containers to react with the content of the tank. Valves 9 are provided in order to permit control of the flow of liquid through the outlet conduit 2 and the loop conduit 3 and in order to permit selective introduction of additive or cleaning agent in addition to the recirculated flow or in place of recirculated flow as will be understood by those skilled in the art. The additive may be introduced either before or after the pump 4.

FIG. 1B shows an embodiment wherein the container for holding a feedstock of additive 13 has been exchanged with a pressurized gas container, permitting gas to be introduced into the flow of liquid into the tank.

The gas may be any suitable gas or gasses of e.g. oxygen, carbon dioxide, methane, hydrogen, nitrogen, and a combination thereof.

Similarly liquids can be introduced into the tank.

Further the loop conduit is provided with a heat exchanger 11, whereas the tank is provided with a jacket 10 for carrying a thermal fluid 14. The heat exchanger 11 permits controlling heating or cooling of the loop flow as will be understood by those skilled in the art. The jacket 10 similarly allows for controlling the temperature of the wall of the tank 1.

Further the tank is provided with a product inlet 15 and a product outlet 16. Although not shown in the Figures, the tank and the flow conduits may be provided with additional facilities, e.g. further feed stocks, static mixers, process tanks, filters, instrumentation, valves, manifolds, inlets, outlets, as will be evident to those skilled in the art.

Although the Figures show a variety of equipment, this is exemplary only and not intended to exclude that parts of such equipment could be dispensed with and that the invention could equally well be implemented in other setups. Although not shown in the Figures, the setup could also be modified by installing in the tank a number of jetting devices, suitably connected for inputting liquid. The provision of more than one jetting device in the tank may serve to extend the coverage and the intensity of the effect of the jets. One particular advantage of the use of more than one jetting device is the capability of mutual cleaning of the exterior of the respective jetting devices.

The inputting of liquid through the rotary jet head creates jets 7 that produce agitation or stirring of the body of liquid inside the tank as indicated by arrows. Due to the double axis rotation of the nozzle, FIG. 1 illustrating just an instantaneous picture of the flow pattern, the flow pattern continually changes. This provides effective agitation of all zones inside the body of liquid.

Reference is now made to FIG. 2 for a description of a particular procedure in operating the plant. FIG. 2 illustrates the same plant as FIG. 1, but during a stage of cleaning of the tank following removal of the batch of liquid from the tank.

At the cleaning state, the valves 9 are operated to input cleaning agent from the feedstock of cleaning agent 12. During this phase, recirculation of the contents withdrawn through the outlet can be maintained or stopped as appropriate. Cleaning agent is ejected through the rotary jet head in the form of jets 7. As the tank is empty during this stage, the jets generally strike the tank walls, thereby dissolving or removing deposits from the tank walls.

Similarly as during the agitation stage, the nozzles are rotated through a broad variety of attitudes, thereby enabling the jets of cleaning agent to sweep practically the entire inside of the tank wall.

During operation of the plant, e.g. for preparing a batch of paint, a batch of base liquid is introduced into the tank through product inlet 15. A flow is withdrawn through outlet conduit 2, boosted by pump 4 and reintroduced through loop conduit 3 and jet head 5 in order to stir the contents of the tank, e.g. for enhancing heat exchange with the tank wall that is also thermally influenced by circulating a fluid in the jacket 10. Pigments for the paint may be introduced either directly through inlet 15 or from feedstock 13 through loop conduit 3 and jet head 5 and mixed into the contents of the tank. The temperature of the loop flow is controlled by the heat exchanger 11. Upon completion of the mixing, the batch is removed through product outlet 16. Subsequently solvent is withdrawn from feedstock 12 and introduced through loop conduit 3 and jet head 5 so as to clean the tank interior.

Reference is now made to FIG. 3, which illustrates a rotary jet head that may be used in practicing the invention, the jet head being illustrated in exploded view. The jet head in FIG. 3 is a so-called slim body jet head 17 generally comprising upper part 23, lower part 24, turbine wheel 22, sun gear 28, upper planet gear 29 and lower planet gear 30. The lower part of the body 24 generally comprises swivel housing 25, hub 26, and jet orifices 21. The hub 26 has the shape of a generally circular cap with a lobe that provides a deflector 36. The hub seats jet orifices 21.

Reference is now made to FIG. 4, which illustrates a section through the slim body jet head also illustrated in FIG. 3. Thus, FIG. 4 shows of the slim body jet head the upper part of the body 23, the lower part of the body 24, swivel housing 25, hub 26 with deflector 36, and turbine wheel 22.

The upper part of the body 23 is adapted, in ways not particularly illustrated, for being secured to a pipe. The lower part of the body generally comprises swivel housing 25 and hub 26. Swivel housing 25 is supported by swivel bearing 37 connected to the upper part of the body 23 in order to permit swiveling of the swivel housing 25 about the axis 18. Similarly the hub 26 is supported by hub bearing 38 relative to the swivel housing 25 in order to permit rotation of the hub 26 about the hub axis 19.

The pipe provides a conduit for inputting liquid or fluid into the rotary jet head. The flow of liquid passes stationary vanes 27 for guiding the flow so as to suitably impact blades of the turbine wheel 22. From the turbine wheel the major part of the flow passes along the planet gears, through volumes internal of swivel housing 25 and hub 24, and out through the jet orifices (ref. FIG. 3).

The turbine wheel is rotated by the impact of the flow and drives planet gear train 20 comprising toothed wheels commencing with sun gear 28 in tooth meshing engagement with upper planet gear 29, which is arranged for epicyclical movement around sun gear 28. Upper planet gear 29 also tooth musingly engages stationary ring gear 31, which is structurally connected to the upper part of the body 23. Upper planet gear 29 is solidly connected with lower planet gear 30 which tooth meshing engages rotary ring gear 32. The lower planet gear has a lower number of teeth than the upper planet gear and the diameter of the rotary ring gear 32 is slightly smaller than the diameter of the stationary ring gear 31 in order to match the lower planet gear 30 appropriately.

The effect of the planet gear train is a substantial reduction of the turbine wheel speed, e.g. by a factor 100–300 depending on the number of teeth on the gear wheels. This provides a positive drive for swiveling swivel housing 25 about the axis 18 of the upper part of the body 23, generally coincident with the axis of the pipe.

The upper part of the body 23 also comprises stationary bevel gear 33 in tooth meshing engagement with rotary bevel gear 34 connected with the hub 26. The bevel gears have a small difference in number of teeth; in a preferred embodiment stationary bevel gear comprises 45 teeth, whereas rotary bevel gear comprises 43 teeth. The effect of this gearing is a linking of the rotation in order that the hub rotates by the swiveling of the swivel housing but at a slightly higher speed of revolution. Thus on one full revolution of the hub, the swivel housing rotates 43/45 times one rotation=344°.

Thus one full revolution of the hub brings back the orientation of one particular nozzle to a point that is offset from the starting orientation by 16° about the swivel axis. Since the hub however comprises 4 nozzle orifices arranged with 90° spacings, the jet traces will generally be indexed by 4° around the equator. As the jet beams generally are divergent by about 6 to 8°, this scanning pattern ensures ample coverage of all directions over a full sphere.

The jet directions will generally on each revolution scan through the polar directions. At parallels between the polar directions and the equator, the lateral indexing of the path will be intermediate these values, i.e. intermediate 4° and 0°. The patterns traced by the jets may be visualized by the plots in FIG. 5.

FIG. 5 illustrates these traces assuming positioning of the rotary jet head in the center of a cylindrical container with horizontal cylinder axis. FIG. 5 includes three partial views, the top one showing a plot of the traces 39 by one revolution of the hub, the mid partial view illustrating the traces by two revolutions of the hub, whereas the bottom partial view illustrates the path traced on 45 revolutions of the hub which is a complete cycle taking the swivel housing as well as the hub back exactly to the starting position.

In other embodiments, the gearing and/or the number of nozzles may be modified in order to adapt the spray pattern and the indexing of the tracks to particular requirements. Guidance for the choice of a particularly effective spray pattern, i.e. particular values for the indexing of the tracks, may be had from U.S. Pat. No. 5,279,675, the contents of which are incorporated hereinto by reference.

As may be understood from FIG. 4, all gears and bearings are exposed to the flow of liquid inside the nozzle device and thus are lubricated and cooled by the liquid. Suitable materials for the gears comprise PTFE (polytetrafluoro-ethylene), E-CTFE (ethylene-chlorotrifluoro-ethylene-copolymere), PEEK (polyether-ether-ketone) and PVDF (polyvinylidene-fluoride), possibly in combination with Stainless Steel AISI316L or others.

Small gaps between the swivel housing and the stationary housing permit egress of small flows of liquid similarly as a small gap between the hub and the swivel housing.

The hub deflector 36 directs part of the flow backwards so as to make it sweep the outside of the swivel housing. Swivel housing is at the bottom provided with a drain hole 35 adapted for permitting draining of the housing interior. All parts of the volume internal of the nozzle device are adapted to make the nozzle device self-draining of liquid.

Reference is now made to FIG. 6, which illustrates a wide body jet head 40 in exploded view. The wide body jet head comprises protuberant jet pipes 41. Similarly as the slim body jet head, the wide body jet head comprises upper and lower housing parts, internal turbine and reduction gear for driving swiveling of the lower housing part and for linking rotation of the hub relative to a hub axis. The wide outline of the lower housing part is due to a slightly different arrangement of the internal gearing, which comprises two stages of worm gears adapted to produce in combination a reduction ratio in the range of 1000 to 3000. Aside from that, the functioning is basically the same as that of the slim body jet head, therefore reference may be made to the explanation of the slim body variant.

The wide body variant is favored for long throw length of the jets and for the impeller effect of the jet pipes, however, at the cost of a wide contour necessitating a larger opening in the tank for installation.

Both variants of the rotary jet head are adapted for handling a broad variety of fluids, e.g. from a viscosity of 0.5 centipoise (such as acetone) to a viscosity of 1000 centipoises (such as heavy fuel oil). Drive pressures may range from 2 to 12 bars, preferably from 3 to 8 Bars.

Reference is now made to FIG. 7 for a description of a shaft drive jetting device shown in FIG. 7 in vertical side view, partially in section. The shaft driven jetting device 42 similarly to the embodiments described above comprises a swivel housing 25 with rotary hub 26. The rotary hub 26 seats jet pipes 41 through which liquid may be ejected in the form of jets 7. Swivel housing 25 is arranged for rotation about a vertical axis while the hub 26 is arranged for rotation relative to the swivel housing about a generally horizontal axis. The rotary movements are coupled by means of stationary bevel gear 33 in tooth meshing engagement with rotary bevel gear 34.

The shaft drive jetting device 42 is secured to a down pipe 44 which is rigidly connected to a flange 45. The flange 45 is adapted for permitting securing to a wall of a tank as will be appreciated by those skilled in the art. Rotation of the swivel housing 25 is effected by rotary shaft 43 which has been solidly connected to swivel housing 25. Rotary shaft 43 is arranged inside down pipe 44 and extends through the length of the pipe and upwards to engage drive unit 46. The drive unit 46 comprises a turbine 47 driven in rotation by the liquid forced into the device. The drive unit 46 comprises gear trains adapted for reducing the speed of revolution to a level suitable for driving the shaft 43. The drive unit also comprises a by-pass valve 48 that may be opened in order to allow part of the flow of liquid to by-pass turbine in order to reduce the power input to the turbine when appropriate.

The unit shown in FIG. 7 is generally adapted for being installed with the flange 45 in contact with a top side wall of a tank or similar such that down pipe 44 and shaft drive jetting device 42 are situated inside the tank while drive unit 46 is generally situated outside the tank. The bevel gears and the bearings in the swivel housing 25 are lubricated by the flow of liquid introduced into the jetting device. On the other hand, the gear train is arranged in the drive unit in a manner sealed from the flow of liquid for the jets and provided with oil or other means of lubricant as will be appreciated by those skilled in the art. Other features of the shaft-drive jetting device are generally similar to those described in relation with the preceding Figures.

As will be appreciated by those skilled in the art, the turbine driven drive unit 46 could easily be substituted by other power means adapted to rotate the shaft 43, e.g. a pneumatic motor, a hydraulic motor, or an electric motor.

Reference is now made to FIGS. 8 and 9 for a description of a multi-stage jetting device. The multi-stage jetting device 49 generally comprises drive unit 46, rotary down pipe 50 and a number of nozzle units 52, FIG. 8 showing three nozzle units 52 arranged along the rotary down pipe. The rotary down pipe is also provided with one or more supports 51 adapted for providing supporting bearings of the shaft.

As shown in the exploded view in FIG. 9, rotary drive shaft 50 comprises an axial drive shaft 43 inside the rotary down pipe.

Each nozzle unit 52 comprises rotary hub 26 with a jet pipe 41. Rotary hub 26 rotates about a horizontal axis driven by a worm gear train comprising worm wheel 54 in tooth-meshing engagement with a worm 53 which is rotated by shaft 43. Thus rotation of the shaft 43 relative to the rotary shaft 50 slowly rotates each of the hubs 26 about the respective horizontal axes. The worm gear train and the bearings inside the nozzle unit are lubricated by the flow of liquid for the jets.

Simultaneously with this rotation the whole pipe 50 is slowly rotated about a vertical axis. This slowly rotates each of the nozzle units 52 about the vertical axis.

In the embodiment shown in FIG. 9, the hub 26 is fitted with just a single jet pipe 41. Thus, the jet will create a net reaction force on the nozzle unit that must be countered by suitable supports to the rotary pipe. When used for agitating a body of liquid, the impact of the jet, however, by the effect of the rotation over time averages to zero. Thus, no bulk rotation is created. Other embodiments of the nozzle unit may comprise more jet pipes on each hub. Other features of the multi-stage jetting device are generally similar to those of the shaft drive jetting device.

The drive unit 56 comprises a motor, e.g. a turbine, a pneumatic motor, a hydraulic motor or an electric motor, and suitable gear trains. The gear trains are adapted to rotate shaft 43 and rotary down pipe 50 by respective different rates of revolution adapted to secure the generally uniform indexed scanning or sweeping of all directions.

Generally, effective agitation and stirring of a body of liquid contained inside a tank according to the present invention is obtained by providing jets from a jetting device to swing in order to effectively cover all directions successively and allow that all internal surfaces of the tank are reached directly by the jets.

In preferred embodiments the jetting device provides beam shaped jets of desired diameter and impact length which jets are particularly suited for long impact distances to the tank wall.

In other preferred embodiments the jetting device provides fan-shaped flat jets of desired angle and optimized impact length, said angle generally covering 360 degrees. However, preferably smaller angles and more flat jets are used depending on the desired impact length.

For jets of the fan-shaped flat type, the flat jet, which is powered by the pressurized liquid, substitutes the powered rotation of a beam of a beam-type jet sweeping a beam of liquid over a section of a sphere. Typically the flat jet of liquid comprises a liquid jetted in a flat cone type section in form of a fan or fan beam whereby the flat jet can cover the same section of a sphere as a swinging beam jet does. However, the fan-type flat jet is provided without use of powered rotation about an axis of rotation as required for a beam jet to sweep the same spherical area. Consequently, the flat jet substitutes one of the rotation axes. An advantage of this embodiment is that fewer mechanical parts are required e.g. no gearing to enable a powered rotation.

For the flat jet, it should be noted, the impact area of the flat jet of liquid is larger than for a beam jet jetting the same amount of liquid. Consequently, the impact length of the flat jet is normally shorter compared to a beam jet. This shorter impact length, however, can be compensated to a certain extent by increasing the pressure of the pressurized liquid. At large pressures, however, there is a tendency for the liquid to atomize. Consequently, rotary flat jets are particularly suited for small tank applications, e.g. tanks having a diameter up to 3–4 meters. For larger tanks, a larger number of flat jets might be required to compensate for this effect and obtain the same level of agitation and stirring to the body of liquid throughout the tank as for beam jets.

Reference is now made to FIGS. 10 and 11 for a description of a rotary flat jetting device 55 that may also be used as a jetting device. A rotary flat jetting device 55 generally comprises a rotary flat jet head 56 supported on jetting device down pipe 57 by a means of a bearing 61 which rotates around one axis only, said flat jetting device making a second powered rotation super-fluous and thereby simplifying the device.

The rotary flat jet head 56 is provided with a number of slots or slits through which flat jets of liquid may merge. The slits comprise bottom slit 58, a pair of slide slits 59 (only the flat jet of the hidden slit is shown in FIG. 10) and a pair of top slits 60. Each of these slits ejects a wide flat jet of liquid, and the aggregate of the flat jet together with rotation of the rotary flat jet head 56 ensure that the flat jet sweeps a complete sphere. The rotation of the rotary flat jet head is driven either by a shaft or by the reaction of the flat jets emerging by the side slits 59 which are oriented at a small angle from the direction through the axis of rotation in order to create a driving torque by the flat jet reaction.

Suitable rotary flat jet heads are supplied by ftejorg A/S, Ishøj, Denmark as rotary spray heads under the trademarks Sani Miget®, Sani Magnum® and Sani Mega®.

Although specific embodiments have been explained above it should be remembered that the invention may be carried out in several ways, and that the explanation merely serves to exemplify the invention and not to limit its scope as defined exclusively by the appended claims.

The invention claimed is:

1. A method for treating a body of liquid in a tank, including the steps of withdrawing a flow of liquid from the body of liquid inside the tank, pressurizing the flow of liquid, reintroducing the flow of liquid into the tank through at least one jetting device, the jetting device introducing the flow of liquid through at least one nozzle located in the body of liquid into the body of liquid inside the tank in order to cause agitation and stirring to the body of liquid, the at least one nozzle being adapted for powered rotation completely about a first axis through 360 degrees and completely about a second axis through 360 degrees which is transverse, perpendicular, or non-perpendicular, to the first axis, said jetting device comprising power means for driving the rotation of the at least one nozzle completely about the first axis through 360 degrees and for driving the rotation of the at least one nozzle completely about the second axis through 360 degrees.

2. The method according to claim 1, wherein the jetting device is mounted on bearings and is constructed and arranged for diverting part of the flow of pressurized liquid to the bearings and to the power means in order to provide lubrication of the bearings and of the power means by the liquid.

3. The method according to claim 1, wherein the jetting device is adapted for providing jets that are generally balanced in order to create no net thrust to the jetting device.

4. The method according to claim 1, comprising adding an ingredient, or more ingredients, to the liquid contained in the tank by way of adding the ingredient(s) either directly to the tank or to the flow prior to being introduced into the tank through the jetting device, said ingredients being one of a gas, a liquid, a solid, or a combination thereof.

5. The method according to claim 1, comprising treating the liquid withdrawn from the tank by means of passing the liquid through any one of static mixer, a filter and a heat exchanger.

6. The method according to claim 1 wherein the jetting device comprises a rotary flat jet device, said rotary flat jet device being adapted for powered rotation about one of said first axis or said second axis; and said power means comprises a turbine driven by said pressurized flow of liquid.

7. The method according to claim 6 wherein the rotary flat jet device comprising a rotary flat jet head rotatably supported on a jetting device down pipe and comprising at least one slot for ejecting a flat jet of liquid.

8. A method for treating a body of liquid in a tank, including the steps of withdrawing a flow of liquid from the body of liquid inside the tank, pressurizing the flow of liquid, reintroducing the flow of liquid into the tank through at least one jetting device, the jetting device introducing the flow of liquid through at least one nozzle located in the body of liquid into the body of liquid inside the tank in order to cause agitation and stirring to the body of liquid, the at least one nozzle being adapted for powered rotation about a first axis and about a second axis perpendicular, or non-perpendicular, to the first axis, said jetting device comprising power means for driving the rotation of the at least one nozzle about the first axis and for driving the rotation of the nozzles(s) about the second axis and wherein the power means comprises gear means adapted to effect rotation about the second axis at a speed of revolution that is different from the speed of revolution about the first axis in order to index the pattern swept by the at least one nozzle.

9. A method for treating a body of liquid in a tank, including the steps of withdrawing a flow of liquid from the body of liquid inside the tank, pressurizing the flow of liquid, reintroducing the flow of liquid into the tank through at least one jetting device, the jetting device introducing the flow of liquid through at least one nozzle located in the body of liquid into the body of liquid inside the tank in order to cause agitation and stirring to the body of liquid, the at least one nozzle being adapted for powered rotation about a first axis and about a second axis which is transverse, perpendicular, or non-perpendicular, to the first axis, said jetting device comprising power means for driving the rotation of the at least one nozzle completely about the first axis through 360 degrees and for driving the rotation of the at least one nozzle completely about the second axis through 360 degrees and the power means comprising one of a turbine driven by the flow of pressurized liquid, a pneumatic motor, a hydraulic motor and an electric motor.

10. A method for treating a body of liquid in a tank, including the steps of withdrawing a flow of liquid from the body of liquid inside the tank, pressurizing the flow of liquid, reintroducing the flow of liquid into the tank through at least one jetting device, the jetting device introducing the flow of liquid through at least one nozzle located in the body of liquid into the body of liquid inside the tank in order to cause agitation and stirring to the body of liquid, the at least one nozzle being adapted for powered rotation about a first axis and about a second axis which is transverse, perpendicular, or non-perpendicular, to the first axis, said jetting device comprising power means for driving the rotation of the at least one nozzle completely about the first axis through 360 degrees and for driving the rotation of the at least one nozzle completely about the second axis through 360 degrees and the jetting device being adapted for self-draining of all liquid.

11. A method for treating a body of liquid in a tank, including the steps of withdrawing a flow of liquid from the body of liquid inside the tank, pressurizing the flow of liquid, reintroducing the flow of liquid into the tank through at least one jetting device, the jetting device introducing the flow of liquid through at least one nozzle located in the body of liquid into the body of liquid inside the tank in order to cause agitation and stirring to the body of liquid, the at least one nozzle being adapted for powered rotation about a first axis and about a second axis which is transverse, perpendicular, or non-perpendicular, to the first axis, said jetting device comprising power means for driving the rotation of the at least one nozzle about the first axis and for driving the rotation of the at least one nozzle about the second axis and the jetting device being adapted to scan the at least one nozzle through a path generally covering a complete sphere.

12. A method of operating a process plant comprising introducing a batch of liquid into a tank, agitating the batch of liquid by reintroducing a flow of liquid into the tank through at least one jetting device, the jetting device introducing the flow of liquid through at least one nozzle located in the body of liquid into a body of liquid inside the tank in order to cause agitation and stirring to the body of liquid, the at least one nozzle being adapted for powered rotation about a first axis and about a second axis perpendicular, or non-perpendicular, to the first axis, said jetting device comprising power means for driving the rotation of the at least one nozzle about the first axis and for driving the rotation of the at least one nozzle about the second axis, withdrawing the batch of liquid from the tank, introducing a pressurized flow of cleaning agent through the jetting device in order to create one or more jet sprays of cleaning agent active to sweep the tank interior and to remove and flush away any residues and withdrawing the flush liquid.

13. The method according to claim 12, the jetting device is mounted on bearings and is constructed and arranged for diverting part of the flow of pressurized liquid to the bearings and to the power means in order to provide lubrication of the bearings and of the power means by the liquid.

14. The method according to claim 12, wherein the power means comprises a gear means adapted to effect rotation about the second axis at a speed of revolution that is different from the speed of revolution about the first axis in order to index the pattern swept by the nozzle(s).

15. The method according to claim 12, wherein th power means comprises one of a turbine driven by the flow pressurized liquid, a pneumatic motor, a hydraulic motor and an electric motor.

16. The method according to claim 12, wherein the jetting device is adapted for self-draining of all liquid.

17. The method according to claim 12, wherein the jetting device is adapted to scan the nozzle(s) through a path generally covering a complete sphere.

18. The method according to claim 12, wherein the jetting device is adapted for providing jets that are generally balanced in order to create no net thrust to the jetting device.

19. The method according to claim 12, comprising adding an ingredient to the batch of liquid in the tank by way of adding the ingredient either directly to the tank or to the flow prior to being introduced into the tank through the jetting device.

20. The method according to claim 12, comprising treating the liquid withdrawn from the tank by means of passing the liquid through any one of a static mixer, a filter and a heat exchanger.

21. The method according to claim 12 wherein the jetting device comprises a rotary flat jet device, said rotary flat jet device being adapted for powered rotation about one of said first axis or said second axis; and said power means comprises a turbine driven by said pressurized flow of liquid.

22. The method according to claim 21 wherein the rotary flat jet device comprising a rotary flat jet head rotatably supported on a jetting device down pipe and comprising at least one slot for ejecting a flat jet of liquid.

* * * * *